US009437352B2

(12) United States Patent
Kameko et al.

(10) Patent No.: US 9,437,352 B2
(45) Date of Patent: Sep. 6, 2016

(54) RESISTOR AND STRUCTURE FOR MOUNTING SAME

(71) Applicant: KOA CORPORATION, Ina-shi, Nagano (JP)

(72) Inventors: Kenji Kameko, Ina (JP); Koichi Hirasawa, Ina (JP)

(73) Assignee: KOA CORPORATION, Ina-shi (JP)

( * ) Notice: Subject to any disclaimer, the term of this patent is extended or adjusted under 35 U.S.C. 154(b) by 105 days.

(21) Appl. No.: 14/383,961

(22) PCT Filed: Mar. 25, 2013

(86) PCT No.: PCT/JP2013/058558

§ 371 (c)(1),
(2) Date: Sep. 9, 2014

(87) PCT Pub. No.: WO2013/146671

PCT Pub. Date: Oct. 3, 2013

(65) Prior Publication Data

US 2015/0048923 A1 Feb. 19, 2015

(30) Foreign Application Priority Data

Mar. 26, 2012 (JP) ..... 2012-069474

(51) Int. Cl.

| | |
|---|---|
| ***H01C 1/14*** | (2006.01) |
| ***H01C 1/142*** | (2006.01) |
| ***H01C 1/144*** | (2006.01) |
| ***H01C 17/28*** | (2006.01) |

(52) U.S. Cl.

CPC ..... *H01C 1/14* (2013.01); *H01C 1/142* (2013.01); *H01C 1/144* (2013.01); *H01C 17/283* (2013.01)

(58) Field of Classification Search

CPC ..... H01C 1/14; H01C 1/142; H01C 13/00
See application file for complete search history.

(56) References Cited

U.S. PATENT DOCUMENTS

| | | | | |
|---|---|---|---|---|
| 6,859,133 | B2 * | 2/2005 | Nakanishi | H01C 7/003 338/309 |
| 2015/0048923 | A1 * | 2/2015 | Kameko | H01C 1/142 338/325 |

FOREIGN PATENT DOCUMENTS

| | | | |
|---|---|---|---|
| JP | 03-080501 | A | 4/1991 |
| JP | 2002-057009 | A | 2/2002 |
| JP | 2004-172502 | A | 6/2004 |
| JP | 3146570 | U | 11/2008 |

OTHER PUBLICATIONS

International Search Report dated Jun. 25, 2013, issued in corresonding application No. PCT/JP2013/058558.

* cited by examiner

*Primary Examiner* — James Harvey
(74) *Attorney, Agent, or Firm* — Westerman, Hattori, Daniels & Adrian, LLP

(57) ABSTRACT

Provided is a resistor for current detection, wherein connection failure etc. due to electro-migration is prevented from being generated in state that the resistor is mounted on a mounting board. The resistor has a resistance body (11) and electrodes (12). The electrode (12) includes first electrode portion (12*a*) connected to the resistance body (11) and second electrode portion (12*b*) formed on the first electrode portion (12*a*). The second electrode portion (12*b*) consists of material having higher resistivity than the first electrode portion (12*a*) and solder, which is used for mounting the resistor on the mounting board.

3 Claims, 4 Drawing Sheets

RESISTOR AND STRUCTURE FOR MOUNTING SAME

TECHNICAL FIELD

The invention relates to a resistor and a structure for mounting the same, especially relating to an electrode structure of the resistor for current detection and a structure for mounting the same.

BACKGROUND ART

The resistor for current detection is used, for an example, for monitoring electrical charge and discharge current of a battery, and for controlling electrical charge and discharge current of the battery etc. The resistor for current detection is inserted in the route of the current to be monitored, the voltage caused at both ends of the resistor by the current is detected, and the current is detected from already-known resistance value of the resistor. Though, there are various types of the resistor for current detection, a structure of the resistor is known, as an example. The resistor is provided with electrodes consisting of copper pieces fixed on both ends of lower surface of plate-shaped metal resistance body (refer to laid-open Japanese patent publication 2002-57009).

However, along with miniaturization of electronic equipments, when large current is applied to the miniaturized resistor, there becomes a situation that current density becomes high at mounted section of the resistor. Because of increase of current density, electro-migration is generated at mounted section of the resistor by solder, and there is a possibility that connection failure happens.

FIG. 1 shows mounting situation of conventional resistor for current detection. Copper is generally used as material for electrode 12, which is disposed at both ends of resistance body 11. The electrode 12 is fixed onto circuit wiring pattern 21 by solder 22. In this case, current density becomes high generally at edges of electrode 12 shown by character A or B. Therefore, according to high current density, electro-migration progresses gradually from portion shown by character A or B, and there is a possibility to become a disconnection.

There is a case that voltage detection terminals are pulled out from between a pair of circuit wiring pattern 21. When electro-migration progresses at a portion shown by character B in FIG. 1, error voltage detection is caused at vicinity of the portion B, and there is a problem that current detection accuracy becomes harmfully influenced.

SUMMARY OF INVENTION

Technical Problem

The invention has been made basing on above-mentioned circumstances. Therefore object of the invention is to provide a resistor for current detection, wherein connection failure or the like due to electro-migration is prevented from being generated in a state that the resistor is mounted on a mounting board.

Solution to Problem

The resistor having a resistance body and electrodes, comprises: the electrode including first electrode portion connected to the resistance body and second electrode portion formed on the first electrode portion; the second electrode portion consisting of material having higher resistivity than the first electrode portion and having higher resistivity than solder, which is used for mounting the resistor on a mounting board.

According to the invention, since the second electrode portion is provided, it contributes to making current density distribution from solder to inside of electrode uniform, and it decrease current concentration at end portion of the electrode. Therefore, tolerance of the resistor for current detection can be improved against electro-migration, which is generated when mounted.

DESCRIPTION OF EMBODIMENTS

Figure 1:
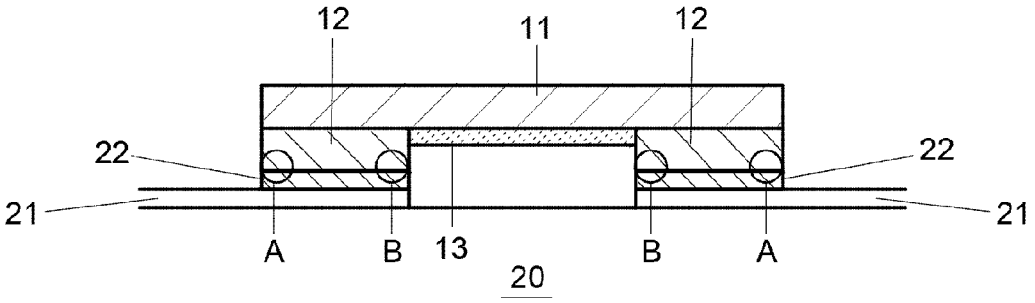
FIG. 1 Prior Art
FIG. 1 is a cross-sectional view of conventional resistor at mounted state.

Embodiments of the invention will be described below with referring to FIG. 2A through FIG. 5. Like or corresponding parts or elements will be denoted and explained by same reference characters throughout views.

Figure 2A:
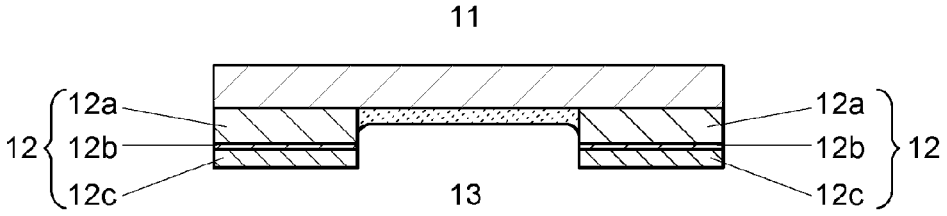
FIG. 2A is a cross-sectional view, which shows a resistor according to first embodiment of the invention.

A resistor shown in FIG. 2A is a resistor for current detection, which has resistance body 11 and electrodes 12 fixed at both ends of lower surface of the resistance body. Resistance body 11 uses resistive material of low resistivity and excellent temperature coefficient of resistance, consisting of copper-nickel system alloy, nickel-chrome system alloy etc. Electrode 12 is provided with first electrode portion 12*a*, second electrode portion 12*b*, and third electrode portion 12*c*. Copper, which is highly conductive material, is used for first electrode portion.

Electrode structure of the invention is characterized in that second electrode portion 12*b* consists of higher resistivity material than first electrode portion 12*a* and third electrode portion 12*c*. For example, an alloy of nickel-chrome or nickel-phosphorus system, which has higher resistivity than copper for first electrode portion and tin for third electrode portion, is used for second electrode portion 12*b*.

Nickel-chrome system alloy is used for second electrode portion 12*b* in the example shown in FIG. 2A. As the example, metal material, which is used for resistance body, may be used for second electrode portion 12*b*. Higher resistivity layer intervenes as second electrode portion 12*b*, and then current density distribution in electrode 12 and inside of solder between resistance body 11 and wiring pattern 21, becomes uniform.

Solder material of tin system is used for third electrode portion 12*c* for securing mounting ability such as solder wet-characteristics. Solder material, which is used generally, can be used for third electrode portion 12*c*. Lead-free solder such as Sn system, Sn—Ag system, or Sn—Cu system, or solder such as Sn—Pb system also can be used. Further, in case that familiar material with solder such as copper-nickel system alloy, for an example, is used for second electrode portion 12*b*, third electrode portion may not be provided.

As to electrical resistivity of metals, which are used for electrodes, copper for first electrode portion is 1.7 μΩ·cm, tin for third electrode portion is 10.9 μΩ·cm, nickel-chrome system alloy for second electrode portion is about 108 μΩ·cm, and nickel-phosphorus system alloy for second electrode portion is about 90 μΩ·cm. As to electrical resistivity of metals for resistance body, copper-nickel system alloy is 49 μΩ·cm, and nickel-chrome system alloy is 108 μΩ·cm. Further, electrical resistivity may be different from above-mentioned numerals according to contained metal components.

As to relation of thickness of each layer of electrode 12, thickness of first electrode portion 12*a* is about 200 μm, thickness of second electrode portion 12*b* is about 5-10 μm, and thickness of third electrode portion 12*c* is about 3-12 μm. It is preferable that second electrode portion 12*b* is formed more thinly than first electrode portion 12*a* and third electrode portion 12*c*.

Figure 3A:
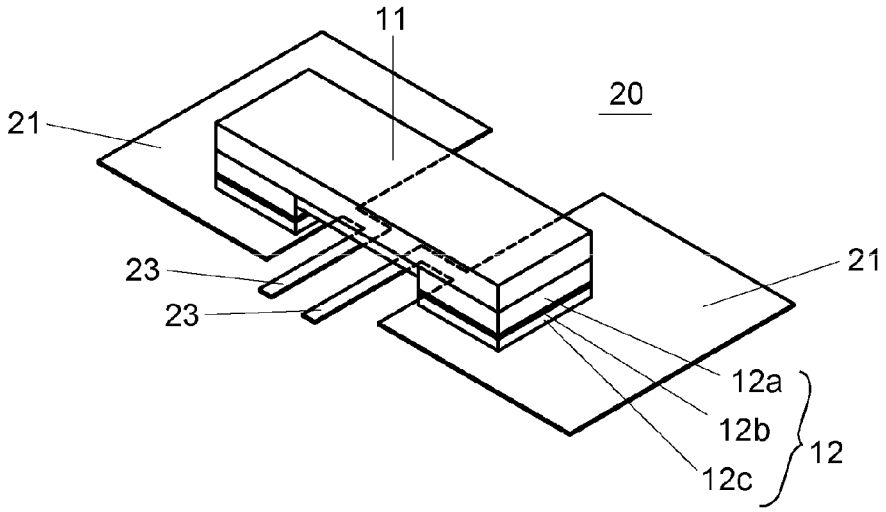
FIG. 3A is a perspective view, which shows mounted state of the resistor according to first embodiment.

FIG. 3A shows structure that the resistor shown in FIG. 2A is mounted on a mounting board. Second electrode portion 12*b* bonded on first electrode portion 12*a* and third electrode portion 12*c* consisting of tin system solder intervene between first electrode portion 12*a* and wiring pattern 21. The resistor is fixed on wiring pattern 21 formed on mounting board 20 by using solder.

Further, solder material is formed beforehand on wiring pattern 21 at a position, where electrode 12 is to be fixed (not shown). The solder material and third electrode portion 12*c* are generally consisting of same tin system metal material. When resistor is mounted, the solder material and third electrode portion 12*c* on wiring pattern 21 are melt by reflow. Accordingly, there becomes no distinction between solder formed on wiring pattern 21 and third electrode portion 12*c*, then mounting state that solder intervenes between second electrode portion 12*b* and wiring pattern 21, is obtained.

According to the invention, second electrode portion 12*b* consisting of metal material having higher resistivity than solder and first electrode portion 12*a* intervenes between the solder and the portion 12*a*. Then, it makes current density distribution inside of electrode 12 and solder uniform, and current concentration to edge portion of electrode 12 becomes reduced (the portion where character A, B shows in FIG. 1). As a result, according to the electrode structure of the invention, it can make the resistor having high tolerance against electro-migration.

In state of being mounted, it is preferable that thickness of second electrode portion 12*b* becomes 1/10 or less of total thickness of solder including solder formed on wiring pattern 21 and third electrode portion 12*c* (formed by reflow at mounted state). As a result, even in case of taking voltage detection terminal 23 at a pair of portion where wiring pattern 21 opposes, generation of error voltage caused by second electrode portion 12*b* having relatively high resistance, can be stopped at least.

Figure 2B:
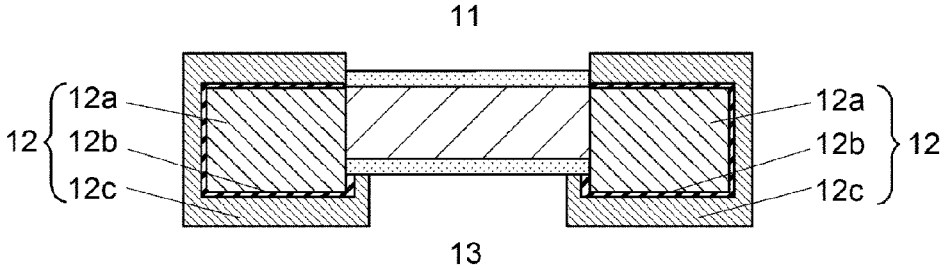
FIG. 2B is a cross-sectional view, which shows a resistor according to second embodiment of the invention.
Figure 3B:
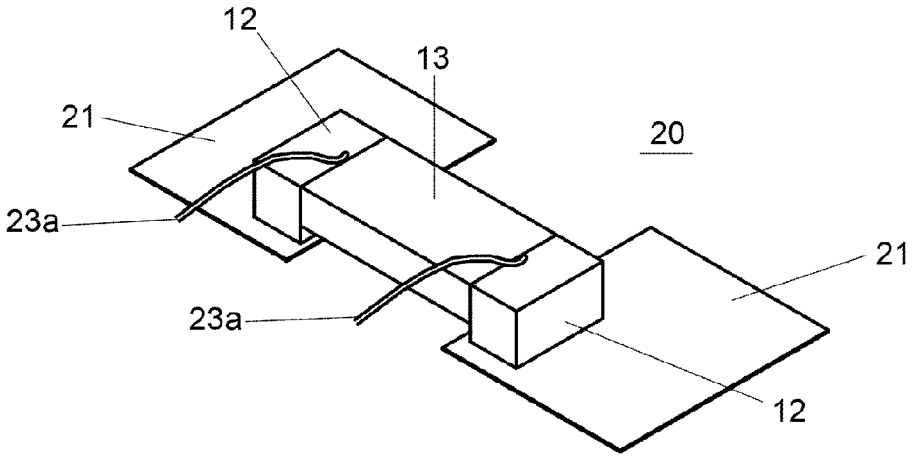
FIG. 3B is a perspective view, which shows mounted state of the resistor according to second embodiment.

FIG. 2B shows a resistor for current detection of second embodiment of the invention, and FIG. 3B shows its mounted state. The resistor has a structure that electrodes 12 are fixed at both end faces of resistance body 11 in lengthwise direction. The electrode 12 has first electrode portion 12*a* of high conductivity material consisting of copper, second electrode portion 12*b* of relatively high resistivity material consisting of nickel-chrome system or nickel-phosphorus system alloy etc., and third electrode portion 12*c* of high conductivity material consisting of tin.

In the example shown in FIG. 2B, nickel-phosphorus alloy film formed by electrolytic plating is used for second electrode portion 12*b*. Third electrode portion 12*c* is a film consisting of tin formed by electrolytic plating. Outer surfaces (upper and lower surfaces and both side surfaces) on resistance body 11 other than joint surface with electrode 12*a* is covered by insulative protective film 13 such as epoxy resin etc. As well as first embodiment, bottom surface of third electrode portion 12*c* is mounted on wiring pattern 21 of mounting board 20 by solder joint. In the embodiment, voltage detection terminal 23 is not taken from wiring pattern 21, but is fixed by wire bonding on upper surface of electrode 12. Further, according to kinds of wire for wire bonding, material for third electrode portion may be changed to nickel etc., for an example.

In the embodiment, since resistivity of second electrode portion 12*b* is higher than solder and copper, density distribution of current flowing through electrode 12 between wiring pattern 21 and resistance body 11 becomes unified. As a result, high current density portion, which is shown by character A or B in FIG. 1, becomes dissolved. And, as well as first embodiment, the resistor can be made to have high tolerance against electro-migration.

Second electrode portion 12*b* covers exposed area of first electrode portion 12*a*. Third electrode portion 12*c* is formed on exposed metal area that is other than area, where protective film 13 covers, by electrolyte plating method etc. Therefore, when mounting, solder such as tin etc. can be prevented from connecting to first electrode portion 12*a* by second electrode portion 12*b* intervening. Further, in the embodiment, since voltage detection terminal 23*a* is not taken from wiring pattern 21, but taken from upper surface of first electrode portion 12*a*, there is an advantage that voltage between both ends of resistance body 11 can be detected accurately without receiving influence of voltage caused by second electrode portion 12*b* of high resistivity.

Figure 4:
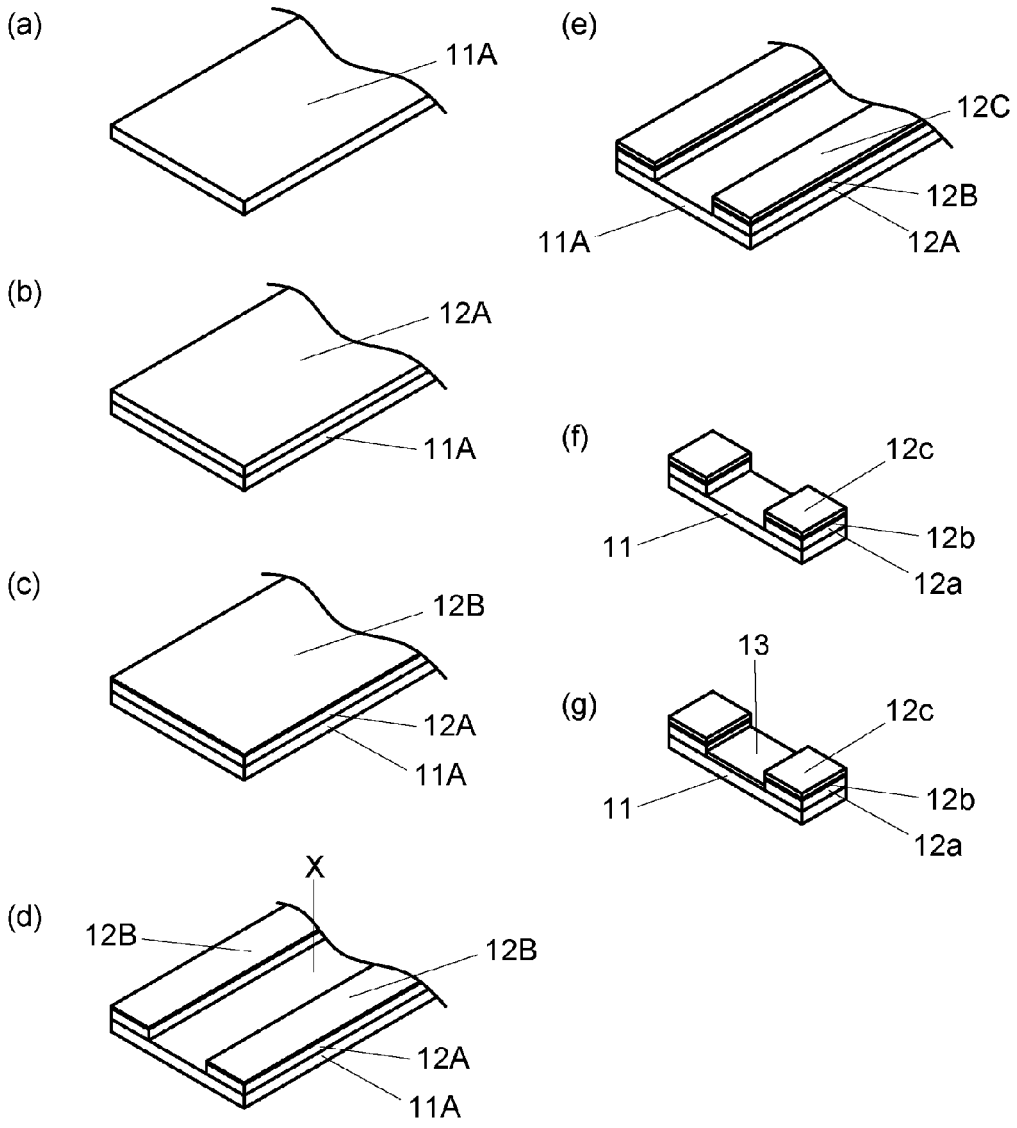
FIG. 4 is a perspective view, which shows manufacturing process of the resistor according to first embodiment.

Next, manufacturing process for resistor of first embodiment of the invention will be described referring to FIG. 4. First, plate material 11A of long size consisting of resistive material such as copper-nickel system alloy is prepared (refer to (a)). And, plate material 12A of copper to be first electrode portion is lapped on plate material 11A (refer to (b)). Further, plate material 12B of nickel-chrome system alloy to be second electrode portion is lapped over there, and cladding material of three layers, where layers are diffusion bonded, is formed by applying pressure and heat (refer to (c)).

Next, a portion of copper plate material 12A and nickel-chrome plate material 12B shown by character X is removed by machining. As a result, portions of copper plate material 12A and nickel-chrome plate material 12B are formed so as to be separated on both sides of resistive plate material 11A (refer to (d)). And, tin film 12C to be third electrode portion is formed on surface of nickel-chrome plate material 12B by dipping surface of the plate material 12B into melt solder in a tank, for an example (refer to (e)). Further, in case of third electrode portion unnecessary, process (e) may be omitted.

Next, above-formed long size plate material is cut into pieces, each corresponding to a resistor. As a result, the resistor having an electrode 12 consisting of first electrode portion 12*a*, second electrode portion 12*b*, and third electrode portion 12*c*, on both ends of plate shaped resistance body 11 is formed (refer to (f)). And, insulative material 13 is formed on exposed surface of resistance body 11 between electrodes 12 at both ends by applying paste such as epoxy resin and heating to be hardened. As a result, the resistor, which is provided with an electrode structure of the invention shown in FIG. 2A, is completed (refer to (g)).

Further, resistor of second embodiment can be manufactured by fixing electrode 12*a* of copper piece to both end faces of square pillar shaped resistance body 11 in lengthwise direction by abutting and diffusion bonding, covering outer surfaces of resistance body 11 with insulative material 13 such as epoxy resin etc., and forming second electrode portion 12*b* of relatively high resistivity film and third electrode portion 12*c* of tin film by electrolyte plating.

Figure 5:
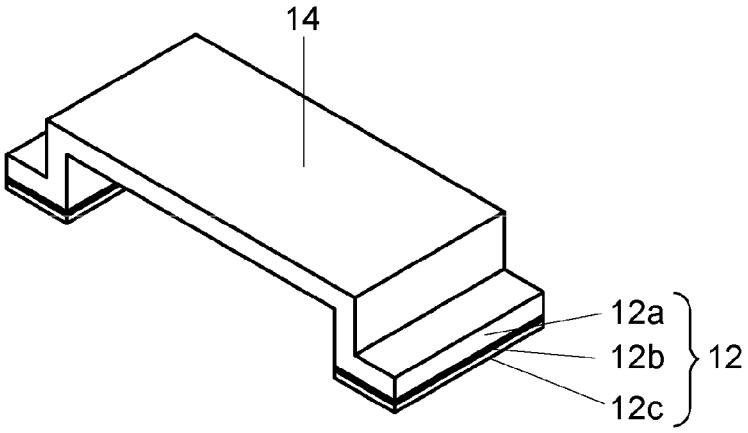
FIG. 5 is a perspective view of an example, wherein electrode structure of the invention is applied to a jumper chip.

FIG. 5 shows an example of jumper chip, which has the electrode structure of the invention. Electrode portion 12 of jumper chip 14 consisting of resistive material such as copper-nickel system alloy etc. has second electrode portion 12*b* of relatively high resistivity and third electrode portion 12*c* of high conductivity such as tin at bottom surface thereof. As a result, current density distribution can be uniformed at inside of electrode 12, and tolerance against electro-migration can be improved as well as before-mentioned each embodiment.

Although embodiments of the invention has been explained, however the invention is not limited to above embodiments, and various changes and modifications may be made within scope of the technical concept of the invention.

INDUSTRIAL APPLICABILITY

In case of making a resistor for current detection smaller, electrode mount area becomes smaller, and then electro-migration becomes problem. Therefore, the invention can be useful for high power surface-mount type resistor.

The invention claimed is:

1. A resistor having a resistance body and electrodes, comprising:

the electrode including first electrode portion connected to the resistance body and second electrode portion formed on the first electrode portion;

the second electrode portion consisting of material having higher resistivity than the first electrode portion and having higher resistivity than solder, which is used for mounting the resistor on a mounting board.

2. The resistor according to claim 1, wherein the electrode further includes third electrode portion, and wherein the second electrode portion intervenes between the first electrode portion and the third electrode portion, and resistivity of the material of the second electrode portion is higher than that of the third electrode portion.

3. A structure for mounting a resistor having a resistance body and electrodes on circuit wiring pattern formed on a mounting board, comprising:

the electrode including first electrode portion connected to the resistance body and second electrode portion formed on the first electrode portion;

the second electrode portion and solder intervening between the circuit wiring pattern and the first electrode portion; and the second electrode portion consisting of material having higher resistivity than the first electrode portion and the solder used for mounting the resistor on the mounting board.

* * * * *